US008424118B2

(12) United States Patent
Maxey et al.

(10) Patent No.: US 8,424,118 B2
(45) Date of Patent: Apr. 23, 2013

(54) UNDERGARMENT

(75) Inventors: Roger L. Maxey, West End, NC (US); Lauren E. Price, Clayton, NC (US)

(73) Assignee: Longworth Industries, Inc., West End, NC (US)

( * ) Notice: Subject to any disclaimer, the term of this patent is extended or adjusted under 35 U.S.C. 154(b) by 349 days.

(21) Appl. No.: 12/846,874

(22) Filed: Jul. 30, 2010

(65) Prior Publication Data

US 2012/0023646 A1 Feb. 2, 2012

(51) Int. Cl.
*A41B 9/00* (2006.01)

(52) U.S. Cl.
USPC ..... 2/400; 2/403; 66/178 A; 66/178 R

(58) Field of Classification Search ..... 2/400, 403, 2/406, 69, 409; 66/178 A, 178 R, 176, 202; 450/37, 153, 156, 102–105; 604/396, 360, 604/385.1
See application file for complete search history.

(56) References Cited

U.S. PATENT DOCUMENTS 4,244,059 A * 1/1981 Pflaumer ..... 2/400
4,454,191 A * 6/1984 von Blucher et al. ..... 442/224
4,455,187 A * 6/1984 von Blucher et al. ..... 156/277
4,510,193 A * 4/1985 Blucher et al. ..... 428/196
5,291,617 A 3/1994 Moretz et al.
5,383,236 A * 1/1995 Sesselmann ..... 2/243.1
5,392,467 A 2/1995 Moretz et al.
5,416,929 A 5/1995 Braunstein
5,435,014 A 7/1995 Moretz et al.
5,508,098 A 4/1996 Omar et al.
5,539,950 A * 7/1996 Zar et al. ..... 15/248.2
5,678,247 A * 10/1997 Vickers ..... 2/69
5,790,987 A * 8/1998 Sesselmann ..... 2/243.1
6,000,057 A * 12/1999 Newman ..... 2/69
6,009,559 A * 1/2000 Sesselmann ..... 2/243.1
6,022,551 A * 2/2000 Jampani et al. ..... 424/405
6,041,446 A 3/2000 Braunstein et al.
6,134,718 A * 10/2000 Sesselmann ..... 2/243.1
6,151,928 A 11/2000 Anyon et al.
6,248,343 B1 * 6/2001 Jampani et al. ..... 424/405
6,723,428 B1 * 4/2004 Foss et al. ..... 428/370
6,841,244 B2 * 1/2005 Foss et al. ..... 428/370
7,008,887 B2 3/2006 Rearick et al.
7,743,476 B2 6/2010 Rock et al.
7,934,268 B2 * 5/2011 Newman ..... 2/79
8,069,496 B2 * 12/2011 Sesselmann ..... 2/69
2004/0210988 A1 10/2004 Lambertz
2005/0176324 A1 8/2005 Michel
2009/0260124 A1 10/2009 Yasui et al.

* cited by examiner

*Primary Examiner* — Gloria Hale
(74) *Attorney, Agent, or Firm* — Womble Carlyle Sandridge & Rice, LLP

(57) ABSTRACT

An undergarment includes a lower body portion having a waist opening and a crotch portion. The crotch portion has a skin contact surface and an outer surface and includes a weft knit fabric portion with at least a first predominately cotton yarn and a second predominately cotton yarn. At least one of the first and second yarns have a moisture wicking treatment applied prior to knitting and comprises at least about 40% of the weight of the weft knit fabric. The weft knit fabric includes an antimicrobial treatment. The undergarment has improved moisture management and comfort properties.

34 Claims, 4 Drawing Sheets

UNDERGARMENT

FIELD OF THE INVENTION

The present invention relates to an improved undergarment, and particularly to an undergarment having improved moisture management.

BACKGROUND OF THE INVENTION

Comfort is an important consideration in the design and manufacture of undergarments. Cotton has long been a preferred fiber for many types of garments and, in particular, for some undergarments. This is because cotton fibers yield soft, smooth fabrics with a hand and feel suitable for next-to-skin applications like underwear, t-shirts, and the like.

Cotton also has processing advantages. Cotton yarn spinning systems are well developed and efficient, making the use of cotton attractive to the apparel designer. Cotton fibers are very moisture absorbent while also retaining moisture within the fiber. This gives cotton certain processing advantages, for example, high moisture content facilitates yarn spinning and knitting. Further, because cotton yarns and fabrics made from such yarns readily absorb water, cotton textiles may be dyed a variety of colors and shades, and are receptive to a variety of textile finishing chemistries. While the absorbency of cotton facilitates yarn processing and dyeing and finishing cotton fabrics, moisture retention may raise problems.

Cotton fibers do not naturally wick moisture away from the wearer when cotton is the only fiber used, because cotton absorbs and retains moisture as discussed above. In certain undergarment applications this causes cotton fibers to retain odor and/or promote bacterial growth, a clearly undesirable affect.

SUMMARY OF THE INVENTION

Inventors have determined that current undergarment constructions have fallen short of maintaining a comfort that cotton fibers provide while providing superior moisture management properties that limit odor retention and bacterial growth. To date, there are undergarments that seek to balance comfort and moisture management at selected portions of the garment that are exposed to moisture, e.g., armpits, crotch areas, etc. These attempts incorporate other fiber types into the fabric structure to improve moisture wicking. The inventors, however, have discovered that the use of cotton yarns, one of which include a moisture treatment applied thereto, improves the moisture management of cotton fabrics, while still maintaining exceptional comfort attributes needed for next-to-skin applications, for example, at the crotch portion of an undergarment.

According to an illustrated embodiment of the invention, the inventors have developed an undergarment having improved moisture management and comfort. The undergarment includes a lower body portion having a waist opening and a crotch portion. The crotch portion has a skin contact surface and an outer surface and includes a weft knit fabric portion with at least a first predominately cotton yarn and a second predominately cotton yarn. At least one of the first and second yarns have a moisture wicking treatment applied prior to the knitting, which yarn comprises at least about 40% of the weight of the weft knit fabric. The weft knit fabric also includes an antimicrobial treatment applied after knitting. The inventor(s) have found that the weft knit fabric portion has surprisingly improved moisture management and comfort properties.

These and other features, aspects, and advantages of the invention will be apparent from a reading of the following detailed description together with the accompanying drawings, which are briefly described below.

DETAILED DESCRIPTION

Figure 1A:
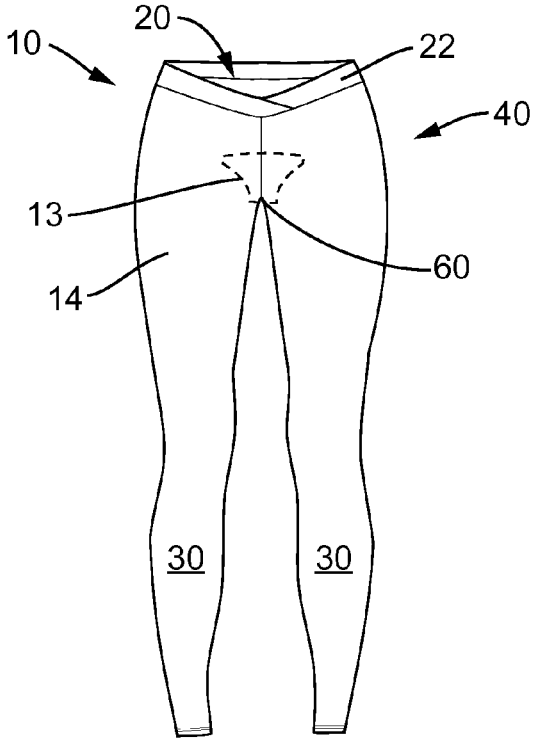
FIGS. 1A and 1B are front and back views of an exemplary undergarment of the present invention.
Figure 1B:
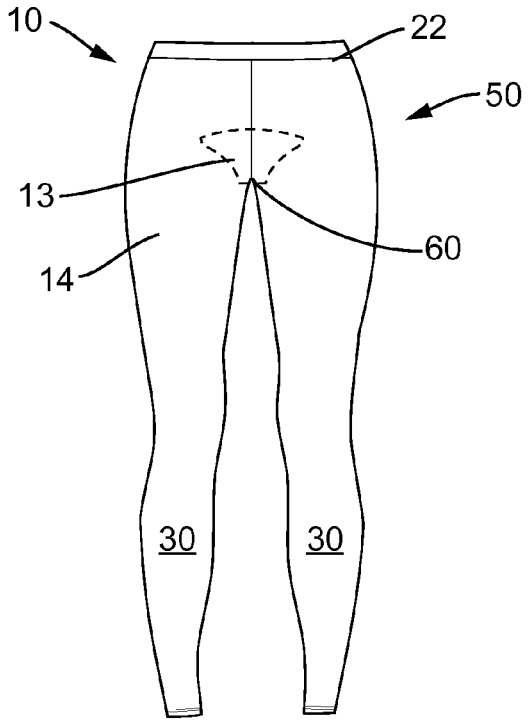
Figure 1C:
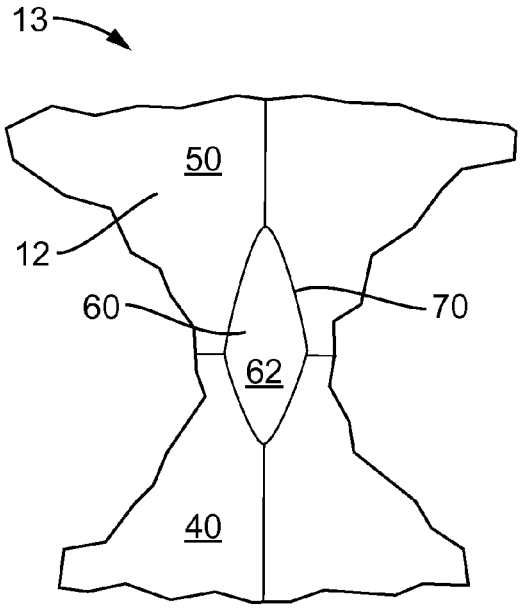
FIG. 1C shows a portion of an undergarment of FIGS. 1A and 1B with an improved crotch portion thereon.
Figure 2A:
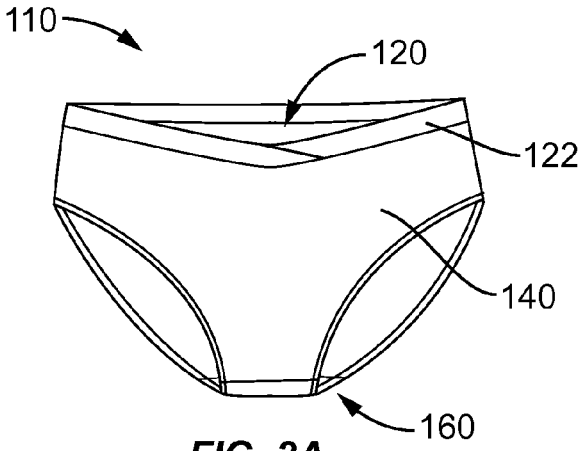
FIGS. 2A through 2C are front, back and front perspective views, respectively, of another exemplary undergarment of the present invention.
Figure 2B:
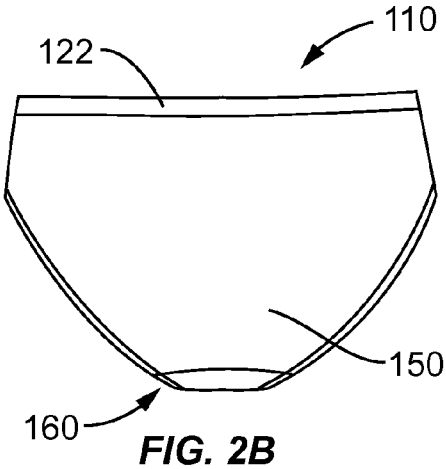
Figure 2C:
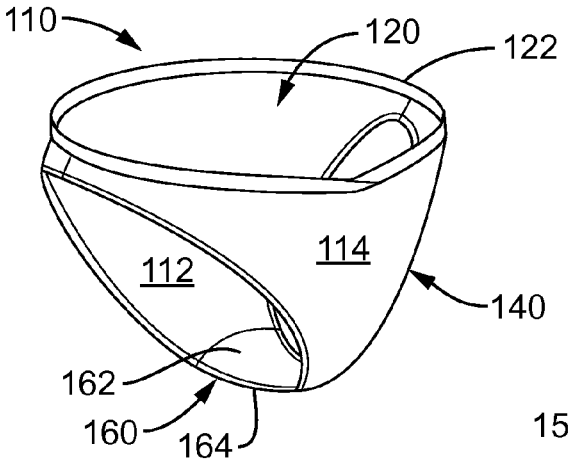
Figure 2D:
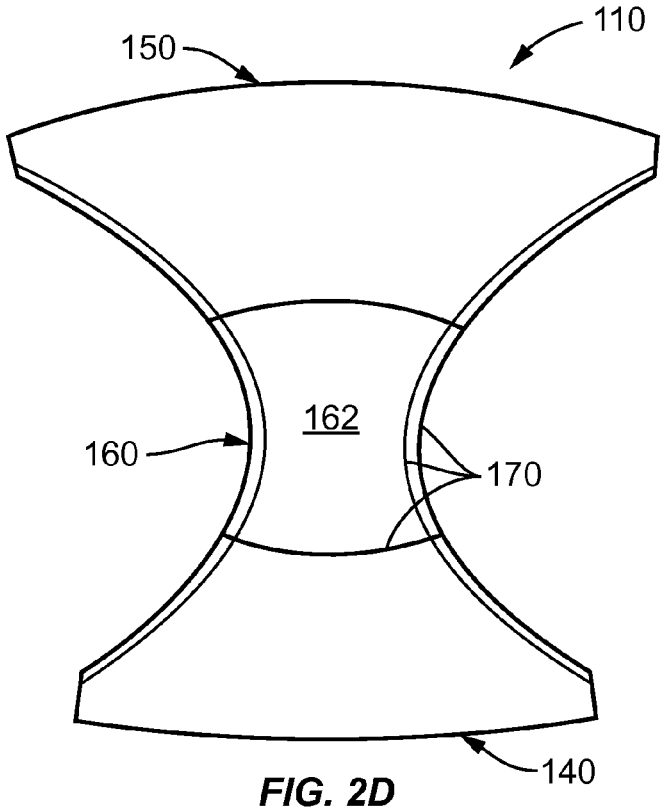
FIG. 2D shows an undergarment having a crotch portion thereon.

Certain exemplary embodiments of the present invention are described below and illustrated in the accompanying figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art and all such alternate embodiments, modifications, and improvements are within the scope of the present invention.

According to common practice, the various features of the drawings discussed below are not necessarily drawn to scale. Dimensions of various features and elements in the drawings may be expanded or reduced to more clearly illustrate the embodiments of the invention.

FIGS. 1A through 4 illustrate various embodiments of an undergarment having improved moisture management properties in the crotch portion thereof. The undergarment itself may be formed of either cotton fibers, synthetic fibers, or blends thereof, and may include women's long underwear 10 as shown in FIGS. 1A through 1C, and women's panties 110 and briefs 210 as shown in FIGS. 2A through 3D. The undergarments may either be formed in pieces and sewn together (fashioned) or seamlessly. Advanced moisture management derives from the inclusion of an improved weft knitted fabric at the crotch portions 60, 160, and 260 (shown in FIGS. 1C, 2D and 3D, respectively) of the undergarments 10, 110 and 210, respectively.

Figure 4:
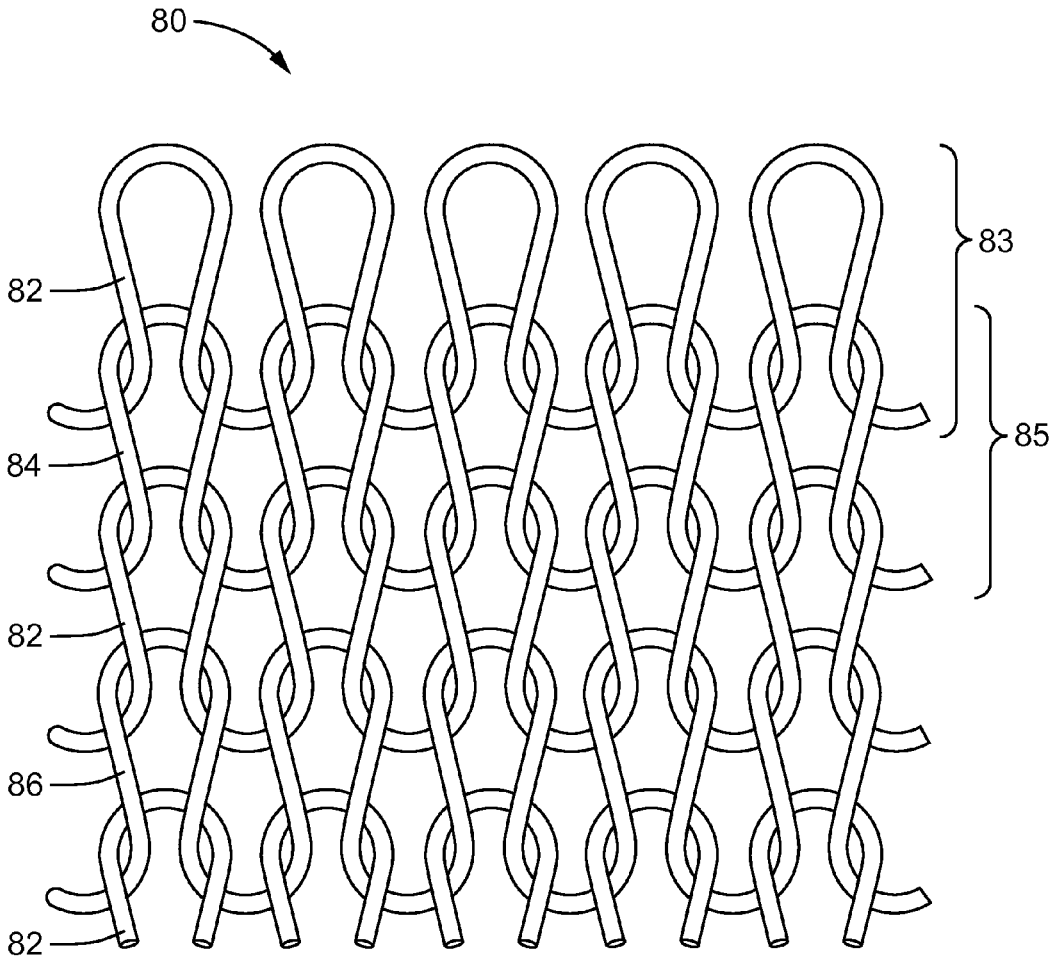
FIG. 4 is a schematic representation of a portion of a weft knit fabric used in the present invention.

Turning initially to FIG. 4, a new weft knit fabric 80 is formed with at least two predominantly cotton yarns, one of which includes the moisture wicking treatment applied prior to the formation of the knit fabric. This combination improves moisture management of crotch 60, 160, 260 while maintaining the comfort, softness and hand that is desirable in undergarments. Further, as will be described in more detail below, the weft knit fabric includes an antimicrobial treatment applied to the weft knit fabric after formation thereof, for the purpose of limiting bacterial growth that may develop.

As shown by FIG. 4, the weft knit fabric 80 includes at least two predominantly cotton yarns: a first yarn 82 and a second yarn 84. While either one of the first or second yarns may be treated, for illustrative purposes the second yarn 84 will be described as having the moisture wicking treatment applied thereto. The first and second yarns 82 and 84 are fed into the knitting machine with alternating feeds such that the first yarn 82 forms a first course 83 and the second yarn 84 forms the second course 85, as shown in FIG. 4. "Alternating courses" refers to every other course in a portion of the knitted fabric. Thus, the first 82 and second 84 yarns forming alternating courses means that adjacent knitted courses will be formed of different yarns, i.e., either a first yarn or a second yarn. In a single jersey construction as shown in FIG. 4, both the first yarn 82 and the second yarn 84 are exposed to the opposing surfaces of the weft knit fabric 80. The weft knit fabric may include other additional yarns as needed. For example, a third yarn 86 comprising an elastic component, e.g., spandex, may be knitted in at a preselected interval during knitting to form the weft knit fabric 80.

The weft knit fabric 80 forming the crotch portion 60, 160 and 260 as described above, can be manufactured on a circular knitting machine. The knitting machine may have a dial and cylinder with a needle gauge set to 28 needles per inch. However, other gauges may be used. In an embodiment, the knitting machine has 120 feeds and 120 cones of a first and second yarns. Sixty ends of the first yarn 82 are fed through 60 feeds and 60 ends of the second yarn 84 are fed through the remaining 60 feeds. In one embodiment, the knitting machine has 2232 needles, a 26 inch diameter, and operates at a speed of 24 rotations per minute. As described above, the first yarn 82 and second yarn 84 are designed to be introduced to the knitting machine in alternating feeds with intermittent feeds of the third spandex yarn. The fabric is removed from the knitting machine, slit and optionally heat set on a tenter frame. The heat set fabric may be bleached and dyed in a soft flow jet with reactive dyes. The fabric can be dried open with a dryer and then finished with the antimicrobial treatment as described above. In other embodiments, the antimicrobial agent is added to the jet during dyeing.

In the weft knit fabric 80, the first yarn 82 may comprise between about 15% to about 60% of the weight of the fabric, preferably between about 21% to about 48% of the weight of the fabric. In a preferred embodiment, the first yarn comprises about 48% of the weight of the knit fabric. The second (with the moisture wicking treatment) yarn 84 may comprise between about 40% to 85% by weight of the fabric, and preferably between about 48% and about 71% by weight of the fabric. In a preferred embodiment, the second treated yarn is about 48% of the weight of the weft knit fabric. A third elastic yarn (not shown) may comprise up to about 8% of the weft knit fabric. In a preferred embodiment, the third elastic yarn 86 comprises about 4% of the weight of the weft knit fabric. In alternate embodiments, more than three yarns may be used.

The first and second yarns 82 and 84 are predominantly cotton fiber yarns with a count suitable for undergarments. In a preferred embodiment, the first and second cotton yarns are formed of pima cotton fibers, although other types of cotton fibers may be used. In another embodiment, the first and second yarns are combed cotton yarns. The first and second yarns may have a cotton count ranging between about 29 cc and about 50 cc. In a preferred embodiment, the cotton count of the first and second yarns is about 36 cc. In an embodiment, the cotton yarns are ring spun. However, the yarns may be open-end, air-jet or vortex spun yarns. The third elastic yarn 86 may have a cotton count of about 40 cc. In other alternate embodiments, the elastic fibers may be blended with other additional fibers to create an elastic property in and to a third yarn.

As discussed above, the second yarn 84 has a moisture wicking treatment applied thereto. A moisture wicking treatment refers to the application of any hydrophobic composition, chemical agents, polymer or resin to the cotton fibers or cotton yarn to minimize or reduce the absorbency of the fiber. The moisture wicking treatment includes the limited removal of natural oils and/or waxes present on cotton fibers, with the purpose of decreasing the absorbency that such cotton fibers would otherwise have. For example, the moisture wicking treatment may include application of any material or materials (referred to herein as a "hydrophobic treatment chemical") that are capable of introducing hydrophobicity into a fiber or yarn. Hydrophobic treatments include application of a hydrophobic treatment material such as, for example, but are not limited to, silicones, fluorochemicals, zirconium compounds, oils, latexes, crosslinking resins such as dimethylol dihydroxy ethylene urea (DMDHEU), urea formaldehyde, ethylene urea, melamine resins, dimethyl urea glyoxal (DMUG), carboxylic acids and polycarboxylic acids including citric, maleic, butane tetra carboxylic, polymaleic acids, and others. Blends of these and other hydrophobic treatment materials may also be used. Further, the hydrophobic treatment may be a fiber preparation process which involves reducing the concentration of the base, such as sodium hydroxide, used in bleach/scouring stages and/or the oxidizing agent, replacing the base and/or the oxidizing agents with other agents, reducing the time of one or both of the scouring or bleaching steps, and/or reducing the temperature in one or both of the scouring or bleaching steps. By modifying the normal scouring and bleaching process, fiber may be produced that is at least partially purified and bleached without removing all of the natural waxes and/or oils on the fiber surface, i.e., all or a portion of the natural waxes and/or oils on the fiber surface are maintained, such that the resulting fiber has a reduced absorbent capacity as compared to normal scoured and bleached cotton. The modification of the present invention may be adjusted as needed to achieve the desired level of purification and whitening as well as the desired level of absorbency/hydrophobicity in the resulting fibers. The moisture wicking treatment described above is described in U.S. Pat. No. 7,008,887, the entirety of which is incorporated by reference herein.

The weft knit fabric 80 may undergo any type of dying and/or finishing step as is needed to produce the desired properties. In an embodiment, an antimicrobial treatment is applied to the weft knit fabric. In particular, the antimicrobial treatment is a composition comprising about up to about 2% by weight of an antimicrobial agent. In an embodiment, the composition may comprise about 2% by weight of an antimicrobial agent. One such antimicrobial agent is triclosan, or 2,4,4' tricholor-2' hydroxydiphenyl ether. Other anti-microbial agents may also be used that are compatible with the fibers and safe to use in apparel worn next to the skin. The antimicrobial treatment may be applied in batch dying and finishing processes for example in jet dying equipment. In alternate embodiments, the antimicrobial treatment may be pad applied, sprayer or foam applied or any other method known to apply a composition to a textile substrate.

The weight of weft knit fabric 80 may range between 3.0 ounces per square yard (OSY) and 8.0 OSY, measured according to ASTM D 3776-Standard Test Methods for Mass Per Unit Area (Weight) of Fabric. In an embodiment, the weft knit fabric 80 may have a finished weight of about 4.6 ounces per square yard. In an embodiment, the weft knit fabric 80 is a single jersey knit, though other knit structures may be used, for example, a double layer knit, eye let mesh, or interlock fabric.

Turning now to FIG. 1A, an exemplary long underwear garment 10 is shown having a front body portion 50, back body portion 40, legs 30, and waist opening 20 circumscribed by waistband 22. As can be seen in the cut-away 13 of undergarment 10 in FIG. 1C, the undergarment 10 includes a crotch portion 60 which is preferably sewn into the undergarment 10 with stitching 70 between the legs 30. Alternatively, it is envisioned that the crotch portion can be knit integrally into the undergarment utilizing more specialized knitting equipment. The crotch portion 60 includes the weft knit fabric 80 which improves the moisture management at the crotch of the wearer. The undergarment 10 has an inside surface 12 (shown on 1C) and an outside surface 14 (shown in FIGS. 1A and 1B). The inside surface 12 refers to the skin contact surface; accordingly the inside surface 62 of the crotch portion also refers to the body adjacent or skin contact surface 12.

Turning now to FIGS. 2A through 2D, the undergarments as described herein can be any form of a brief and/or panty. As such, the panty 110 shown in FIGS. 2A-2C, has a waist opening 120, circumscribed by a waistband 122 and connecting the front and back portions 140 and 150. Sewn into the undergarment 110 is a crotch portion 160 that has a body adjacent surface 162 and an outer surface 164 (stitches 170 shown in FIG. 2D). The crotch portion 160 is formed of the weft knit fabric 80 as described above. Further, the undergarment 110 itself has an inner skin contact surface 112 and an outer surface 114.

Figure 3A:
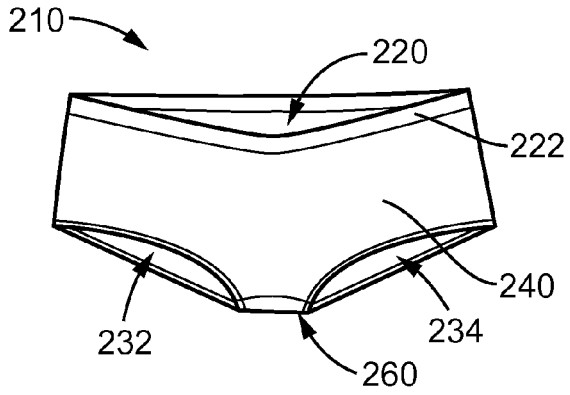
FIGS. 3A through 3C are front, back and front perspective views, respectively, of another exemplary undergarment of the present invention.
Figure 3B:
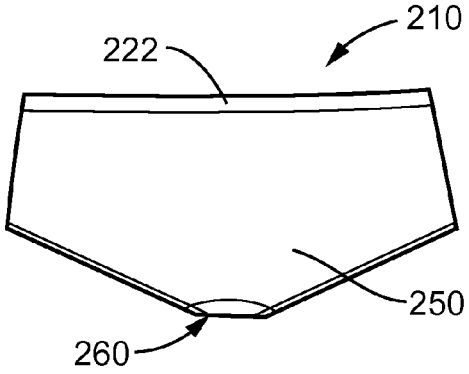
Figure 3C:
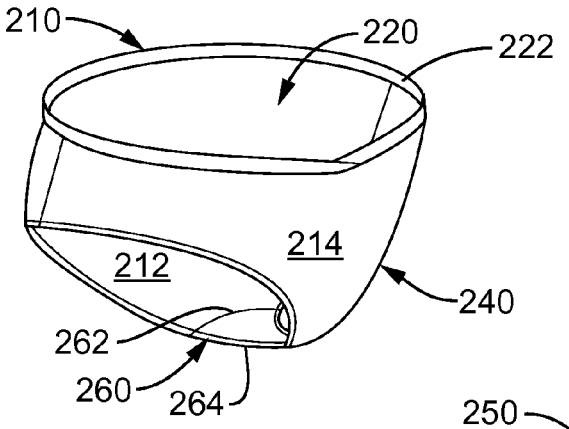
Figure 3D:
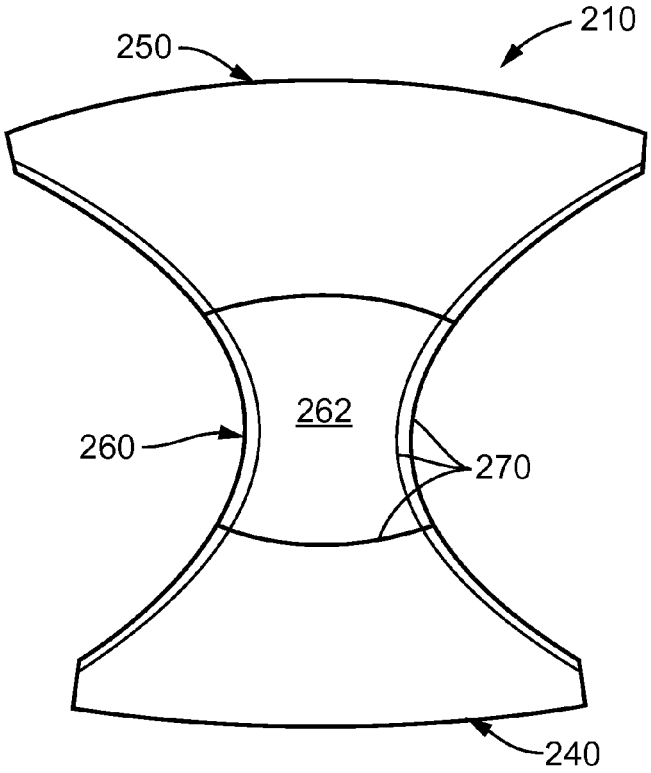
FIG. 3D shows a portion of an undergarment having a crotch portion thereon.

Turning now to FIGS. 3A through 3D, an exemplary brief 210 is shown. Again, the brief 210 has a waist opening 220 circumscribed by a waist band 222 connecting front and back portions 240 and 250. A crotch portion 260 is sewn therein (the stitches 270 are shown in FIG. 3D. As described above, the brief 210 has an inner skin contact surface 212 and outer surface 214. The crotch portion with an improved weft knit fabric as discussed above, includes an inner skin contact portion 262 opposite of which is the outer surface 264.

The undergarments 10, 110 and 210 each have improved moisture management fabric therein, which is formed of predominantly cotton yarns for improved comfort and hand.

Weft knit fabrics formed as described display improved moisture management properties over 100% cotton fabrics, synthetic fabrics, or blends thereof. Comparative tests were conducted to assess the moisture management of the fabric as described herein. The following table summarizes the samples used in this study.

TABLE 1

| Sample | Yarn Construction | Weight (osy) | Construction |
|---|---|---|---|
| A | 100% cotton yarn | 4.5 | Single jersey |
| B | 48% −40/1 pima cotton,<br>48% −40/1 treated combed cotton yarn<br>4% −elastic yarn | 4.5 | Single jersey |
| C | 48% −40/1 cotton yarn,<br>48% −40/1 treated cotton yarn<br>4% −elastic yarn | 4.5 | Single jersey |
| D | 100% polyester yarn | 5 | Single jersey |
| E | 100% polyester yarn | 4.4 | Single jersey |
| F | 100% polyester yarn | 4.0 | Interlock |

Samples B and C were produced as described herein including at least one yarn having a moisture wicking treatment. Sample B was formed with cotton yarns formed from Pima cotton fibers. Samples A through E were subjected to a fabric drying time test using a heated balance. To evaluate the heated balance dry time, first cut a 7.5 in diameter circle, weigh the sample, and determine the absorbent capacity of the sample using the Absorbency Testing System (e.g., the ATC-600, available from Thwing Albert Instrument Company). The samples are then wet out with water at atmospheric conditions, i.e., room temperature. The heated balance is set to 98.6° F. (37° C.). The samples are then dried on the heated balance until the sample is within 5% of its original weight. Samples B and C showed drying times of approximately 41 and 39 minutes, respectively. Compared to a drying time of more than 75 minutes for sample A, and more than 65 minutes for samples C, D and E, samples B and C display much faster drying times, approximately half that of conventional cotton and synthetic fabrics.

A "saturated dry time" test was also performed on samples A through F. This test includes cutting a 15.25 cm×15.25 cm square sample, recording its original weight, and determining its absorbent capacity using the ATS-600 discussed above. The sample is then wet out to 50% of its absorbent capacity and placed on a scale. The time it takes until the sample is dry, or is within 5% of its original weight, is recorded. Samples B and C display a saturated drying time of about 185 and 175 minutes, respectively. Sample A saturated dry time is in excess of about 275 minutes. Synthetic fabric samples C, D and E showed a drying time greater than about 200 minutes. Accordingly, sample B and C having an improved fabric construction and moisture management yarn, reduced the saturated fabric dry time by 50% compared to untreated cotton and synthetics.

Samples G, H, and I, summarized in table 2 below, were subjected to additional tests to measure overall moisture management capability (OMMC) (an index to indicate the overall capability of the fabric to manage the transport of liquid), spreading speed, max wetted radius, absorption rate, and wetting time. The properties are measured according to AATCC TM 195-Liquid Moisture Management Properties of Textile Fabrics. Table 2 displays the constructions for samples G, H, and I.

TABLE 2

| Sample | Yarn Construction | Weight (osy) | Construction |
|---|---|---|---|
| G | 49% −40/1 combed cotton,<br>49% −40/1 treated combed cotton yarn<br>2% −elastic yarn | 6.5 | Interlock |
| H | 1/70/68 textured polyester yarn | 4.0 | Eyelet mesh |
| I | 30/1 polyester ring spun yarn<br>1/150/144 textured polyester yarn | 5.5 | Double layer |

TABLE 3

Moisture Management Tester Data

| TEST | G | H | I |
|---|---|---|---|
| OMMC | 0.432 | 0.408 | 0.389 |
| Spreading Speed - Face (mm/sec) | 6.211 | 4.960 | 4.318 |
| Spreading Speed - Back (mm/sec) | 6.328 | 5.105 | 4.257 |
| Max Wetted Radius - Face (mm) | 30.000 | 25.000 | 23.000 |
| Max Wetted Radius - Back (mm) | 29.000 | 25.000 | 20.000 |
| Absorption Rate - Face (%/sec) | 55.763 | 57.078 | 54.706 |
| Absorption Rate - Back (%/sec) | 59.869 | 58.720 | 65.557 |
| Wetting Time - Face (sec) | 2.647 | 2.859 | 3.656 |
| Wetting Time - Back (sec) | 2.697 | 2.875 | 3.625 |

Tables 3 displays data values obtained for each sample G, H, and I generated by the Moisture Management Tester (MMT) equipment for samples listed in Table 2 above. As can be seen in table 3, the wetting time and absorption rate have similar results, all of which are considered good. The "wetted radius" is a measure of a fabric's ability to spread moisture. The wetted radius values for the two synthetic fabric samples H and I range from 20-25 mm. The wetted radius values for sample G is considered very good and is about 20% higher than the synthetic fabric samples H and I. Spreading speed is a measure of how quickly the moisture is spread over the surface of the fabric. While all three samples have good spreading speeds, the sample G fabric spreading speeds are 25% better than the synthetic fabric samples H and I. Accordingly, the sample G outperforms the two synthetic fabric samples H and I in terms of moisture management.

Although the present invention has been described with exemplary embodiments, it is to be understood that modifications and variations may be utilized without departing from the spirit and scope of the invention, as those skilled in the art will readily understand. Such modifications and variations are considered to be within the purview and scope of the appended claims and their equivalents.

What is claimed is:

1. An undergarment having increased moisture management and comfort, the undergarment comprising:

a lower body portion having a waist opening, two leg portions or openings, and a crotch portion between the two leg portions or openings;

the crotch portion having a skin contact surface and an outer surface, the crotch portion including a weft knit fabric portion comprising at least a first predominately cotton yarn and a second predominately cotton yarn, at least the second yarn having a moisture wicking treatment thereon wherein the second yarn comprises at least about 40% of the weight of the weft knit fabric portion; and an antimicrobial treatment applied to the weft knit fabric;

whereby the at least two predominantly cotton yarns provide increased moisture management and comfort to the undergarment when worn.

2. The undergarment of claim 1, wherein the weft knit fabric has a first knitted course formed with the first yarn and a second knitted course formed with the second yarn having the moisture wicking treatment applied thereto, the first and second knitted courses alternating in a portion of the weft knit fabric.

3. The undergarment of claim 1, wherein the weft knit fabric further comprises a third yarn formed at least partially of an elastic fiber.

4. The undergarment of claim 3, wherein the weft knit fabric comprises up to about 8% of the third yarn.

5. The undergarment of claim 1, wherein about 15% to about 60% of the weft knit fabric weight is of a cotton yarn.

6. The undergarment of claim 1, wherein about 21% to about 48% of the weft knit fabric weight is formed of the first yarn.

7. The undergarment of claim 1, wherein about 48% of the total weft knit fabric weight comprises the first yarn.

8. The undergarment of claim 1, wherein about 40% to 85% of the total weft knit fabric weight comprises the second treated yarn.

9. The undergarment of claim 1, wherein between about 48% and about 71% of the total weft knit fabric weight comprises the second treated yarn.

10. The undergarment of claim 1, wherein about 48% of the weft knit fabric weight is of the second treated yarn.

11. The undergarment of claim 1, wherein each of the first yarn and the second yarn have a cotton count between about 29 cc and about 50 cc.

12. The undergarment of claim 1, wherein the moisture wicking treatment is a hydrophobic composition.

13. The undergarment of claim 1, wherein the moisture wicking treatment is a treatment that reduces the absorbency of the second treated cotton yarn.

14. The undergarment of claim 1, wherein the second treated cotton yarn comprises cotton fibers, and the moisture wicking treatment is a treatment whereby a portion of the cotton fibers that form the second yarn are partially cleaned.

15. The undergarment of claim 1, wherein the antimicrobial composition comprises triclosan.

16. The undergarment of claim 1, wherein the weft knit fabric portion has a weight between about 3.0 ounces per square yard and about 8.0 ounces per square yard.

17. The undergarment of claim 1, in which the crotch portion is knit separately and sewn into the undergarment.

18. An undergarment for a female selected from the group consisting of long underwear, a brief and a panty, and having increased moisture management and comfort, the undergarment comprising:

a lower body portion and a crotch portion;

the crotch portion having a skin contact surface and an outer surface, the crotch portion including a weft knit fabric portion comprising at least first predominately cotton yarns and second predominately cotton yarns, at least the second yarns having a moisture wicking treatment thereon, wherein the second yarn comprises at least about 40% of the weight of the weft knit fabric portion; and an antimicrobial treatment applied to the weft knit fabric;

whereby the at least two predominantly cotton yarns provide increased moisture management and comfort to the undergarment when worn.

19. The undergarment of claim 18, wherein the weft knit fabric has a first knitted course formed with the first yarn and a second knitted course formed with the second yarn having the moisture wicking treatment applied thereto, the first and second knitted courses alternating in a portion of the weft knit fabric.

20. The undergarment of claim 18, wherein the weft knit fabric further comprising a third yarn formed at least partially of an elastic fiber.

21. The undergarment of claim 20, wherein the weft knit fabric comprises up to about 8% of the third yarn.

22. The undergarment of claim 18, wherein about 15% to about 60% of the weft knit fabric weight is of a cotton yarn.

23. The undergarment of claim 18, wherein about 21% to about 48% of the weft knit fabric weight is of a cotton yarn.

24. The undergarment of claim 18, wherein about 48% of the total weft knit fabric weight comprises the first yarn.

25. The undergarment of claim 18, wherein about 40% to 85% of the total weft knit fabric by weight comprises the second treated yarn.

26. The undergarment of claim 18, wherein between about 48% and about 71% of the total weft knit fabric weight comprises the second treated yarn.

27. The undergarment of claim 18, wherein about 48% of the weft knit fabric weight of the second yard.

28. The undergarment of claim 18, wherein each of the first yarn and the second yarn have a cotton count between about 29 cc and about 50 cc.

29. The undergarment of claim 18, wherein the moisture wicking treatment is a hydrophobic composition.

30. The undergarment of claim 18, wherein the moisture wicking treatment is a treatment that reduces the absorbency of the second treated cotton yarn.

31. The undergarment of claim 18, wherein the second treated cotton yarn comprises cotton fibers, and the moisture wicking treatment is a treatment whereby a portion of the cotton fibers that form the second yarn are partially cleaned.

32. The undergarment of claim 18, wherein the antimicrobial composition comprises triclosan.

33. The undergarment of claim 18, wherein the weft knit fabric portion has a weight between about 3.0 ounces per square yard and about 8.0 ounces per square yard.

34. The undergarment of claim 18 in which the crotch portion is knit separately and sewn into the undergarment.

* * * * *